US008052495B2

(12) United States Patent
Kato et al.

(10) Patent No.: US 8,052,495 B2
(45) Date of Patent: Nov. 8, 2011

(54) METHOD FOR PRODUCING SPARK PLUG BY PROJECTION WELDING AND SPARK PLUG THEREOF

(75) Inventors: Tomoaki Kato, Aichi (JP); Kazuyoshi Torii, Aichi (JP); Mamoru Musasa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 479 days.

(21) Appl. No.: 12/057,242

(22) Filed: Mar. 27, 2008

(65) Prior Publication Data

US 2008/0238282 A1 Oct. 2, 2008

Related U.S. Application Data

(60) Provisional application No. 60/988,937, filed on Nov. 19, 2007.

(30) Foreign Application Priority Data

Mar. 28, 2007 (JP) ..... 2007-085309

(51) Int. Cl.
*H01T 21/02* (2006.01)

(52) U.S. Cl. ..... 445/7; 313/142

(58) Field of Classification Search ..... 445/7; 313/118–145, 238

See application file for complete search history.

(56) References Cited

U.S. PATENT DOCUMENTS

| | | | | |
|---|---|---|---|---|
| 6,597,089 | B2 * | 7/2003 | Matsutani | 313/141 |
| 6,621,198 | B2 * | 9/2003 | Kanao et al. | 313/141 |
| 6,630,771 | B1 | 10/2003 | Ulm et al. | |
| 6,923,699 | B2 | 8/2005 | Matsubara et al. | |
| 7,084,558 | B2 * | 8/2006 | Teramura et al. | 313/141 |
| 2002/0070646 | A1 * | 6/2002 | Chiu | 313/141 |
| 2003/0181121 | A1 * | 9/2003 | Matsubara et al. | 445/7 |
| 2004/0041506 | A1 | 3/2004 | Teramura et al. | |
| 2006/0061250 | A1 * | 3/2006 | Yoshimoto et al. | 313/141 |
| 2006/0238092 | A1 | 10/2006 | Teramura et al. | |

FOREIGN PATENT DOCUMENTS

| | | | |
|---|---|---|---|
| CN | 1463061 | A | 12/2003 |
| JP | 57-163976 | A | 10/1982 |
| JP | 57163976 | A | 10/1982 |
| JP | 8-298178 | A | 11/1996 |

(Continued)

OTHER PUBLICATIONS

Welding Technology; Jun. 1, 1988; pp. 118-125.

(Continued)

*Primary Examiner* — Peter Macchiarolo
(74) *Attorney, Agent, or Firm* — Sughrue Mion, PLLC

(57) ABSTRACT

A spark plug (100) including a center electrode (130) and a ground electrode (140), which is formed by joining a ground electrode chip (143) to a ground electrode base material (141) via an intermediate member (142). A method for producing the spark plug (100) includes providing a projecting portion (142*p*) on the intermediate member (142), and projection-welding the intermediate member (142) to the ground electrode base material (141) by means of the projecting portion (142*p*), to thereby join the intermediate member 142 to the ground electrode base material (141). Further, the intermediate member (142) of the spark plug (100) includes a cylindrical columnar portion (142*e*) which is joined to the ground electrode chip (143), and a flange portion (142*d*) which is joined to the ground electrode base material (141) and which flange portion (142*d*) has a diameter greater than that of the cylindrical columnar portion (142*e*).

7 Claims, 9 Drawing Sheets

FOREIGN PATENT DOCUMENTS

| | | | |
|---|---|---|---|
| JP | 8298178 | A | 11/1996 |
| JP | 9-106879 | A | 4/1997 |
| JP | 9106879 | A | 4/1997 |
| JP | 2002-524821 | A | 8/2002 |
| JP | 2002524821 | A | 8/2002 |
| JP | 2004-127916 | A | 4/2004 |
| JP | 2004-134209 | A | 4/2004 |
| JP | 2004127916 | A | 4/2004 |
| JP | 2004134209 | A | 4/2004 |

OTHER PUBLICATIONS

Chinese Office Action corresponding to Chinese Patent Application No. 200810089108.7 dated Jun. 11, 2010.

* cited by examiner

METHOD FOR PRODUCING SPARK PLUG BY PROJECTION WELDING AND SPARK PLUG THEREOF

CROSS-REFERENCE TO RELATED APPLICATIONS

This application claims benefit from Provisional Application No. 60/988,937 filed Nov. 19, 2007, incorporated herein by reference in its entirety.

BACKGROUND OF THE INVENTION

1. Field of the Invention

The present invention relates to a method for producing a spark plug for an internal combustion engine and to a spark plug manufactured by the method, and more particularly, to a method for producing a spark plug having an outer electrode in which an outer electrode chip is joined to an outer electrode base material via an intermediate member and to a spark plug manufactured by the method.

2. Description of the Related Art

Conventionally known spark plugs include spark plugs having a center electrode and an outer electrode in which an outer electrode chip is joined to an outer electrode base material via an intermediate member. For example, Patent Document 1 and Patent Document 2 disclose such a spark plug.

In Patent Document 1, the outer electrode of a spark plug is produced as follows. That is, a chip-shaped electrode material (outer electrode chip) which is resistant to spark-induced ablation is joined to an end of a bar-shaped member (intermediate member) made of a base metal resistant to corrosion, by means of TIG welding (tungsten inert gas welding) or laser welding. Subsequently, the corrosion-resistant base metal member (intermediate member) is cut to an appropriate dimension. The flat surfaces of the corrosion-resistant base metal member (intermediate member) and the outer electrode (outer electrode base material) are brought into contact with each other, and welded together through resistance welding, whereby the outer electrode is formed (see claims and other sections of Patent Document 1).

In Patent Document 2, the outer electrode is produced as follows. That is, an intermediate member having first and second parallel surfaces is fabricated in advance, and a chip (outer electrode chip) is laser-welded to the first surface of the intermediate member. Subsequently, the second surface of the intermediate member and a joint surface of the electrode base material (outer electrode base material) are brought into contact with each other, and are welded together through resistance welding, whereby the outer electrode is formed (see claims and other sections of Patent Document 2). The resistance welding between the intermediate member and the electrode base material (outer electrode base material) is performed by supplying current thereto while pressing a circumferential edge portion of the intermediate member by means of an electric resistance welding machine (see FIG. 4 and its description in Patent Document 2).

[Patent Document 1] Japanese Patent Application Laid-Open (kokai) No. H8-298178

[Patent Document 2] Japanese Patent Application Laid-Open (kokai) No. 2004-134209

3. Problems to be Solved by the Invention

However, when a spark plug produced in accordance with Patent Document 1 or 2 is subjected to a thermal cycle test in which a thermal cycle of heating the spark plug to a high temperature and then naturally cooling is repeated a large number of times, a large gap may be produced between the intermediate member and the outer electrode base material at a radially central portion thereof. Such a gap results in deteriorated reliability of the joint between the intermediate member and the outer electrode base material. Further, in some cases, a hollow portion is generated in a fused metal alloy portion between the outer electrode chip and the intermediate member at an outer periphery of the fused metal portion.

Conceivably, the reason why a large gap is produced between the intermediate member and the outer electrode base material at a radially central portion thereof is as follows. That is, when the intermediate member and the outer electrode base material are resistance-welded, a circumferential edge portion of the intermediate member is pressed against the outer electrode base material. Therefore, at that circumferential edge portion, the intermediate member and the outer electrode base material are mixedly fused and welded without fail. However, since no pressure is applied to a radially central portion of the intermediate member, at that central portion, the intermediate member and the outer electrode base material are not reliably welded in some instances. Therefore, when a thermal cycle test is performed, due to thermal stress produced at that time, a large gap tends to form at a radially central portion at which the intermediate member and the outer electrode base material are not reliably welded.

Further, the reason why a hollow portion is formed in the fused metal portion between the outer electrode chip and the intermediate member is as follows. That is, when a large gap is present between the intermediate member and the outer electrode base material at a radially central portion thereof as described above, transfer of heat from the outer electrode chip to the outer electrode base material deteriorates. Therefore, during a thermal cycle test, the fused metal portion between the outer electrode chip and the intermediate member is exposed to high temperature. As a result, the fused metal portion is subject to high-temperature oxidation, so that an alloy which constitutes the fused metal portion is gradually consumed, and a hollow portion is formed. Further, in the spark plug of Patent Document 1, in order to secure a sufficient joining area between the intermediate member and the outer electrode base material, the entire intermediate member must be increased in size. In contrast, in the spark plug of Patent Document 2, the intermediate member has a stepped structure; i.e., has a cylindrical columnar portion having a smaller diameter and a flange portion having a larger diameter. Thus, it is possible to adjust the diameter of the flange so as to secure a sufficient joint area, while matching the diameter of the cylindrical columnar portion with the diameter of the outer electrode chip. However, since the intermediate member is configured such that the cylindrical columnar portion disappears during laser welding, and only the flange portion is left after the laser welding, the incident angle of a laser beam during the laser welding is likely to be restricted by the flange portion.

SUMMARY OF THE INVENTION

The present invention has been made in view of the above circumstances, and an object thereof is to provide a method for producing a spark plug having an outer electrode chip joined to an outer electrode base material via an intermediate member, wherein a large gap is hardly generated between the intermediate member and the outer electrode base material, and wherein a hollow recess is hardly generated in a fused metal portion between the outer electrode chip and the intermediate member even when subjected to severe thermal cycling. Another object of the invention is to provide a spark plug manufactured by the production method.

The above object of the invention has been achieved by providing, in a first aspect, a method for producing a spark plug which includes a center electrode and an outer electrode facing the center electrode via a discharge gap and configured such that an outer electrode chip is joined to an outer electrode base material via an intermediate member, the method comprising projection-welding the intermediate member to the outer electrode base material by means of a projecting portion provided on at least one of the intermediate member and the outer electrode base material.

The production method according to the present invention comprises a projection welding step of projection-welding the intermediate member to the outer electrode base material by means of a projecting portion provided on at least one of the intermediate member and the outer electrode base material. This enables the intermediate member and the outer electrode base material to be reliably welded together over a wider area as compared with a case where a conventional resistance welding technique is employed. Accordingly, when a spark plug thus produced undergoes a severe thermal cycle test, it is possible to prevent a large gap from forming between the intermediate member and the outer electrode base material. Further, since the intermediate member and the outer electrode base material are reliably welded together over a wide area, heat transfer from the outer electrode chip to the outer electrode base material is improved. Accordingly, when a spark plug thus produced undergoes a severe thermal cycle test, it is possible to prevent formation of a hollow recess in a fused metal portion between the outer electrode chip and the intermediate member, which hollow recess would otherwise be generated due to high-temperature oxidation.

Notably, the projecting portion may be provided on the intermediate member or the outer electrode base material only, or provided on both of them. Further, a single projecting portion or a plurality of projecting portions may be provided. Also, the shape of the projecting portion may be freely changed, so long as the selected shape is suitable for projection welding. For example, the projecting portion may assume a circular columnar shape or a square columnar shape. Moreover, the projecting portion may have a spherical distal end surface or a pointed distal end.

In a preferred embodiment, the projecting portion is provided on at least one of the intermediate member and the outer electrode base material such that, at the time of projection welding, the projecting portion is located radially inward of a circumferential edge of the intermediate member.

As described above, if a large gap is generated between the intermediate member and the outer electrode base, in particular, at a radially central portion thereof, transfer of heat from the outer electrode chip to the outer electrode base material deteriorates, so that during a thermal cycle test, a hollow recess is likely to be generated in a fused metal portion between the outer electrode chip and the intermediate member due to high-temperature oxidation.

In contrast, according to the present invention, the projecting portion is provided on at least one of the intermediate member and the outer electrode base material such that, at the time of projection welding, the projecting portion is located radially inward of a circumferential edge of the intermediate member. Therefore, when the above-described projection welding is carried out, portions of the intermediate member and the outer electrode base material located on the radially inner side of the circumferential edge of the intermediate member are likely to be reliably welded together, so as to prevent a large gap from forming between the radially inner portions of the intermediate member and the outer electrode base material. Accordingly, even when a spark plug thus produced undergoes a severe thermal cycle test, it is possible to more reliably prevent a hollow recess from forming in a fused metal portion between the outer electrode chip and the intermediate member, which recess would otherwise be generated due to high-temperature oxidation.

In the above-described method for producing a spark plug, preferably, the projecting portion is provided on at least one of the intermediate member and the outer electrode base material such that, at the time of projection welding, the projecting portion is located at a radially central portion of the intermediate member.

According to the present invention, the projecting portion is provided on at least one of the intermediate member and the outer electrode base material such that, at the time of projection welding, the projecting portion is located at a radially central portion of the intermediate member. Therefore, when the above-described projection welding is carried out, portions of the intermediate member and the outer electrode base material located at a radially central portion of the intermediate member are likely to be reliably welded together so as to enhance heat transfer. Thus, formation of a large gap between the radially central portions of the intermediate member and the outer electrode base material is prevented. Accordingly, even when a spark plug thus produced undergoes a severe thermal cycle test, it is possible to even more reliably prevent a hollow recess from forming in a fused metal portion between the outer electrode chip and the intermediate member, which recess would otherwise be generated due to high-temperature oxidation.

In yet another preferred embodiment, the projecting portion has an average cross sectional area of 0.03 $mm^2$ to 0.2 $mm^2$ inclusive, as measured perpendicular to an axial direction of the projecting portion, and a projection length of 0.05 mm to 0.2 mm inclusive.

When the average cross sectional area of the projecting portion is less than 0.03 $mm^2$ and excessively small or is greater than 0.2 $mm^2$ or when the projection length is less than 0.05 mm and excessively small or is greater than 0.2 mm, at the time of projection welding, some difficulty may be encountered in reliably welding the intermediate member to the outer electrode base material over a large area.

In contrast, according to the present invention, the projecting portion has an average cross sectional area of 0.03 $mm^2$ to 0.2 $mm^2$ inclusive and a projection length of 0.05 mm to 0.2 mm inclusive, whereby, at the time of projection welding, the intermediate member and the outer electrode base material can more reliably be welded together over a large area.

Notably, the term "average cross sectional area" refers to a value obtained by averaging the area of a cross section of the projecting portion taken perpendicular to the axial direction of the projecting portion, from an axially distal end to an axially proximal end of the projecting portion. Further, in a case where a plurality of projecting portions are provided, the term "average cross sectional area" refers to the sum of the respective average cross sectional areas of these projecting portions.

In yet another preferred embodiment, the method comprises pressing a brim portion of the intermediate member by a resistance welding machine at the time of projection welding, the brim portion having a thickness of 0.2 mm or greater.

If the thickness of the brim portion of the intermediate member, which portion is pressed by a resistance welding machine is less than 0.2 mm and excessively small, at the time of projection welding, deformation such as warpage may be generated at the brim portion, resulting in a deficiency associated with welding.

In contrast, according to the present invention, the brim portion, which is pressed by a resistance welding machine, has a thickness of 0.2 mm or greater. Accordingly, at the time of projection welding, no deformation results at the brim portion, so that the intermediate member and the outer electrode base material can be welded together more reliably.

In yet another preferred embodiment, the intermediate member is formed of a nickel alloy containing nickel in an amount of 80 wt % or more.

As described above, in a case where heat transfer from the outer electrode chip to the outer electrode base material is poor, when a severe thermal cycle test is carried out, a hollow recess is likely to be generated in a fused metal portion between the outer electrode chip and the intermediate member due to high-temperature oxidation.

In order to overcome this drawback, in the present invention, the intermediate member is formed of a nickel alloy containing nickel in an amount of 80 wt % or more. Therefore, the intermediate member has a high thermal conductivity, so that the heat transfer from the outer electrode chip to the outer electrode base material is improved. Accordingly, even when a severe thermal cycle test is carried out, it is possible to more reliably prevent a hollow recess from forming in a fused metal portion between the outer electrode chip and the intermediate member.

In yet another preferred embodiment, the intermediate member comprises a nickel alloy portion formed of a nickel alloy, and a copper metal portion embedded in the nickel alloy portion.

As described above, in a case where heat transfer from the outer electrode chip to the outer electrode base material is poor, when a severe thermal cycle test is carried out, a hollow recess is likely to be generated in a fused metal portion between the outer electrode chip and the intermediate member due to high-temperature oxidation.

In order to overcome this drawback, in the present invention, the intermediate member includes a nickel alloy portion formed of a nickel alloy, and a copper metal portion embedded in the nickel alloy portion. Since the intermediate member includes a copper metal portion which has a considerably high thermal conductivity, the thermal conductivity of the entire intermediate member is also high, so that heat transfer from the outer electrode chip to the outer electrode base material is improved. Accordingly, even when a severe thermal cycle test is carried out, it is possible to more reliably prevent a hollow recess from forming in a fused metal portion between the outer electrode chip and the intermediate member.

In yet another preferred embodiment, the method comprises forming the projecting portion on at least one of the intermediate member and the outer electrode base material by means of header working or press working.

According to the present invention, the projecting portion is provided on at least one of the intermediate member and the outer electrode base material by means of header working (see, for example, U.S. Pat. Nos. 6,597,089, 7,084,558 and 7,321,137 incorporated herein by reference) or press working (see, for example, U.S. Pat. Nos. 6,960,729, 6,583,366 and 6,359,332 incorporated herein by reference). This step allows easy and reliable formation of the projecting portion.

In a second aspect, the present invention provides a spark plug comprising a center electrode and an outer electrode. The outer electrode includes a noble metal chip facing the center electrode via a discharge gap; an outer electrode base material; an intermediate member for connecting the noble metal chip and the outer electrode base material; and a fused metal portion formed between the noble metal chip and the intermediate member by means of laser welding. The intermediate member includes a cylindrical columnar portion which is joined to the noble metal chip, and a flange portion which is joined to the outer electrode base material and which has a diameter greater than that of the cylindrical columnar portion.

According to the present invention, the spark plug is configured such that the cylindrical columnar portion remains after completion of laser welding. Therefore, at the time of laser welding, the flange portion does not restrict the incident angle of a laser beam, so that the fused metal portion can be readily formed. In addition, the fused metal portion can be separated from the flange portion by a certain distance or more. In such a case, deterioration of the fused metal portion hardly occurs when the intermediate member is joined to the outer electrode base material via the flange portion by means of resistance welding or the like. Notably, in a preferred embodiment of the second aspect, the spark plug satisfies a relation $0.05\ \text{mm} \leqq h1 \leqq 0.3\ \text{mm}$ where h1 represents the height of the cylindrical columnar portion.

In yet another preferred embodiment of the second aspect, the fused metal portion is formed over the entirety of a joint surface between the noble metal chip and the cylindrical columnar portion, and a relation $h1 < h2$ is satisfied, where h2 represents a distance between a lower end of the fused metal portion and an upper surface of the flange portion as measured along a center line of the noble metal chip. In particular, in a case where the projection portion used for projection welding between the intermediate member and the outer electrode base material is provided at the center of a lower surface of the flange portion, the temperature becomes highest in the vicinity of the center of the flange portion. At such a central portion, the fused metal portion can become separated from the high temperature portion.

In yet another preferred embodiment of the second aspect, the spark plug satisfies a relation $h3 > h1$ where h3 represents a projection height of the noble metal chip as measured from the fused metal portion. In this manner, the projection height h3 of the ground electrode chip accounts for a greater portion of the predetermined projection height H (see FIG. 3) than does the height h1 of the cylindrical columnar portion, whereby the resistance of the outer electrode to spark-induced ablation can be improved.

BRIEF DESCRIPTION OF THE DRAWINGS

FIGS. 4A and 4B relate to a method of producing the spark plug according to Embodiment 1, wherein FIG. 4A is a side view of an intermediate member used in producing the spark plug, and FIG. 4B is a plan view of the intermediate member as viewed from the projecting portion side.

FIGS. 9A and 9B relate to a spark plug according to Embodiment 2, wherein FIG. 9A is a side view of an intermediate member used in producing the spark plug, and FIG. 9B is a plan view of the intermediate member as viewed from the projecting portion side.

FIGS. 10A and 10B relate to a spark plug according to Embodiment 3, wherein FIG. 10A is a side view of an intermediate member used in producing the spark plug, and FIG. 10B is a plan view of the intermediate member as viewed from the projecting portion side.

DESCRIPTION OF REFERENCE NUMERALS

Figure 1:
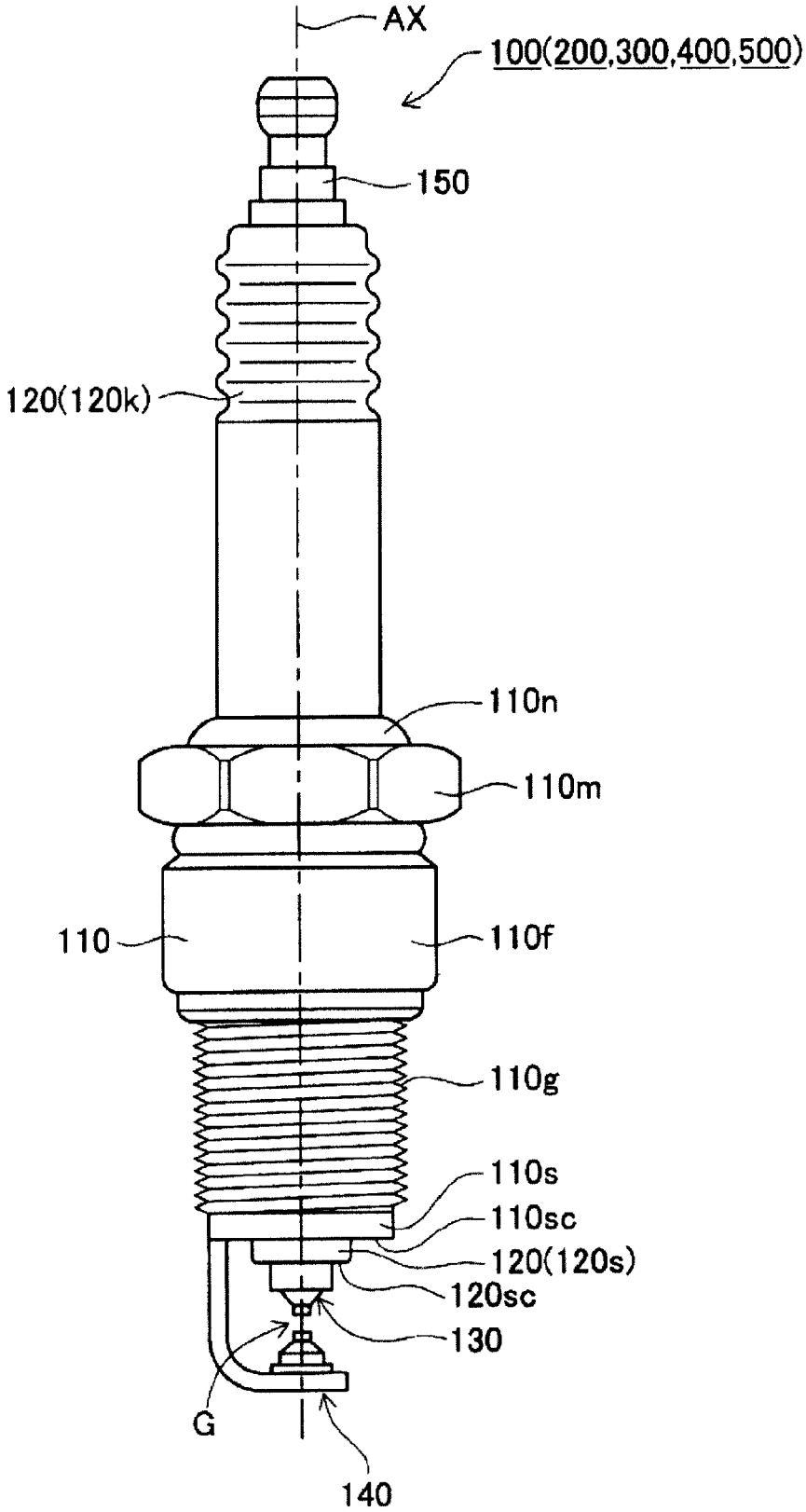
FIG. 1 is a side view of a spark plug according to Embodiment 1.

Reference numerals used to identify various structural elements of the drawings include:

100, 200, 300, 400, 500: spark plug
130: center electrode
131: center electrode base material
133: center electrode chip
140: ground electrode (outer electrode)
141, 441: ground electrode base material (outer electrode base material)
141*g*, 441*g*: Cu metal portion
141*h*, 441*h*: high-Ni-content alloy portion
142, 242, 342, 542: intermediate member
142*d*, 242*d*, 342*d*, 542*d*: flange portion (brim portion)
242*g*, 342*g*, 542*g*: Cu metal portion
242*h*, 342*h*, 542*h*: high-Ni-content alloy portion
142*p*, 242*p*, 342*p*, 441*p*, 542*p*: projecting portion
143: ground electrode chip (outer electrode chip)
145: resistance-welded portion
146: fused metal portion
AX: axis
G: discharge gap
L: projection length
D: thickness
TY: resistance welding machine

DETAILED DESCRIPTION OF THE PREFERRED EMBODIMENTS

Embodiment 1

Embodiments of the present invention will now be described in detail with reference to the drawings. However, the present invention should not be construed as being limited thereto.

Figure 2:
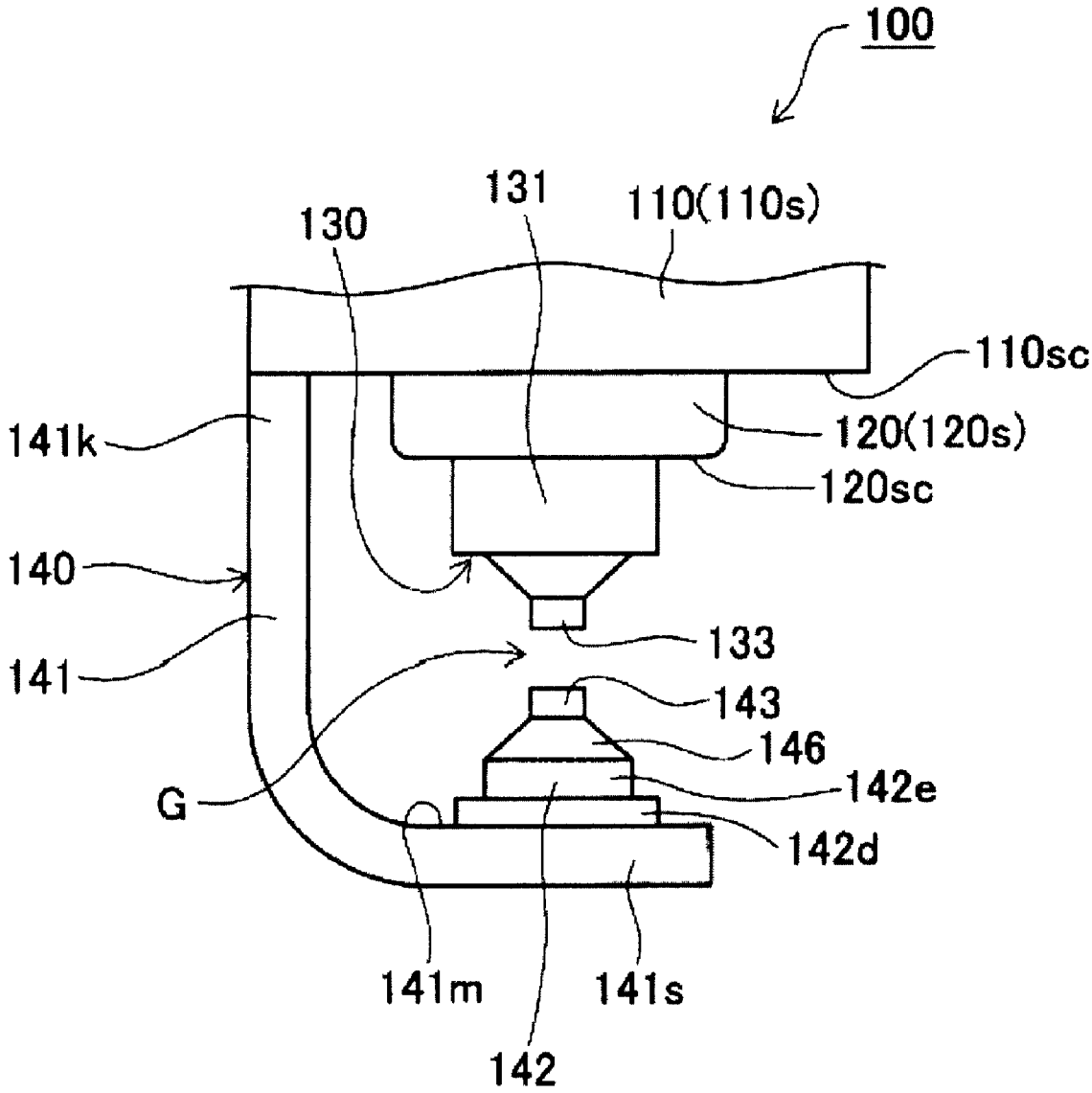
FIG. 2 is an enlarged partial view of the spark plug according to Embodiment 1 showing a center electrode, a ground electrode, and their surrounding portions.
Figure 3:
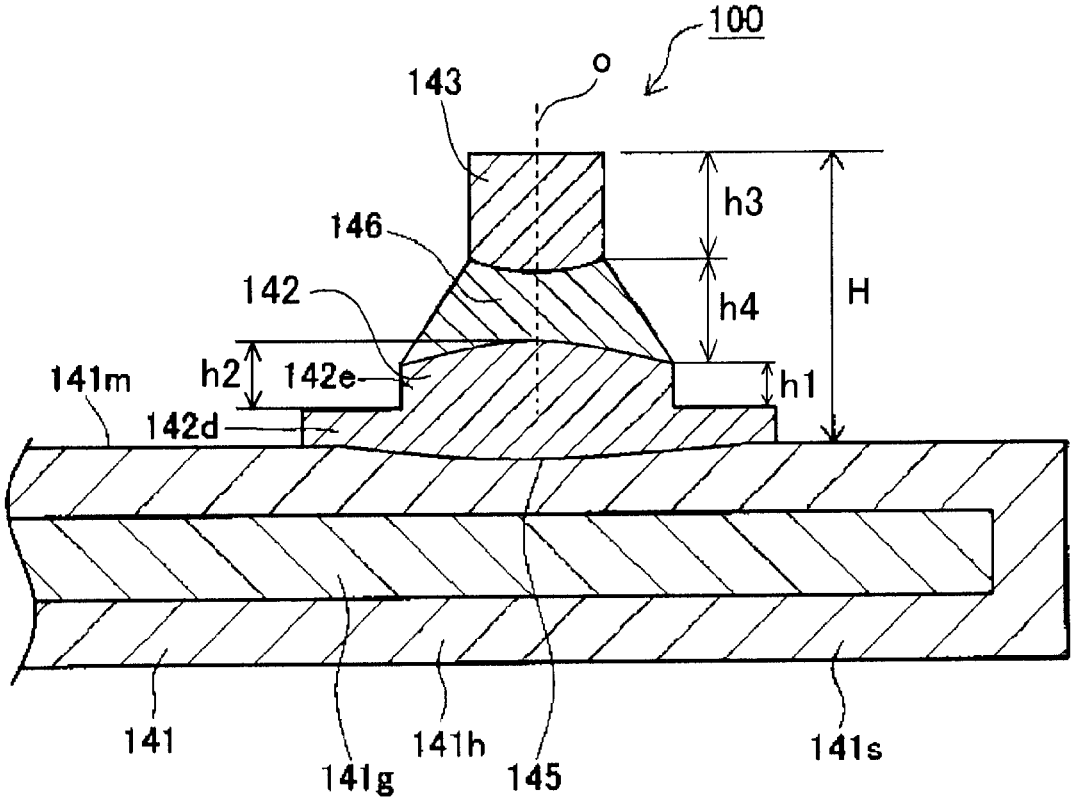
FIG. 3 is an enlarged partial view of the spark plug according to Embodiment 1 showing a distal end of the ground electrode and its vicinity.

FIG. 1 shows a spark plug 100 according to Embodiment 1. FIG. 2 shows a center electrode 130, a ground electrode (outer electrode) 140, and their surrounding portions. FIG. 3 shows a distal end of the ground electrode 140 and its vicinity. This spark plug 100 is a spark plug for an internal combustion engine which is attached to the cylinder head of the engine.

As shown in FIG. 1, the spark plug 100 includes a metallic shell 110, an insulator 120, a center electrode 130, and a ground electrode 140.

The metallic shell 110 is formed of low carbon steel, and assumes the form of a cylinder extending along the direction of an axis AX. The metallic shell 110 includes a flange portion 110*f* having a large diameter; a tool engagement portion 110*m* which is located on the proximal end side (upper side in FIG. 1) of the flange portion 110*f* and has a hexagonal cross section and with which a tool is engaged when the spark plug 100 is attached to the cylinder head; and a crimp portion 110*n* which is located on the proximal end side of the tool engagement portion 110*m* and used to fix the insulator 120 to the metallic shell 110 through crimping. Further, on the distal end side (lower side in FIG. 1) of the flange portion 110*f*, the metallic shell 110 includes a distal end portion 110*s* which is smaller in diameter than the flange portion 110*f* and has an attachment screw portion 110*g* formed on the outer circumference thereof. The attachment screw portion 110*g* is used to screw the spark plug 100 into the cylinder head.

The insulator 120 is formed of an alumina-based ceramic, and its circumference is surrounded by the metallic shell 110. A distal end portion 120*s* of the insulator 120 projects toward the distal end side (lower side in FIG. 1) from a distal end surface 110*sc* of the metallic shell 110. A proximal end portion 120*k* of the insulator 120 projects toward the proximal end side (upper side in FIG. 1) from the crimp portion 110*n* of the metallic shell 110. An axial hole extending along the direction of the axis AX is formed in the insulator 120. The center electrode 130 is inserted into and fixed to the distal end side (lower side in FIG. 1) of the axial hole, and a metal terminal 150 for supplying high voltage to the center electrode 130 is inserted into and fixed to the proximal end side (upper side in FIG. 1) of the axial hole.

The center electrode 130 is held by the insulator 120 in a state in which the center electrode 130 projects toward the distal end side (lower side in FIG. 1) from a distal end surface 120*sc* of the insulator 120. As shown in FIG. 2, this center electrode 130 is composed of a center electrode base material 131 located on the proximal end side (upper side in FIG. 2), and a center electrode chip 133 located on the distal end side (lower side in FIG. 2).

The center electrode base material 131 assumes the form of a cylindrical column, and is composed of a Cu metal portion, and a high-Ni-content alloy portion enclosing the Cu metal portion. The Cu metal portion is formed of copper, which has a high thermal conductivity. The high-Ni-content alloy portion is formed of a nickel alloy containing nickel in an amount of 80 wt % or more (specifically, INCONEL® 600).

The center electrode chip 133 assumes the form of a cylindrical column, and is joined to the center electrode base material 131 by means of laser welding such that the center electrode chip 133 projects toward the distal end side (lower side in FIG. 2). This center electrode chip 133 is formed of a noble metal alloy; specifically, an Ir—Pt alloy.

Meanwhile, as shown in FIGS. 2 and 3, the ground electrode 140 is composed of a ground electrode base material (outer electrode base material) 141 located on the distal end side (lower side in these drawings); a ground electrode chip (outer electrode chip) 143 located on the proximal end side (upper side in these drawings); and an intermediate member 142 disposed between the ground electrode base material 141 and the ground electrode chip 143.

The ground electrode base material 141 is composed of a Cu metal portion 141*g*, and a high-Ni-content alloy portion 141*h* enclosing the Cu metal portion 141*g*. The Cu metal portion 141*g* is formed of copper, which has a high thermal conductivity. The high-Ni-content alloy portion 141*h* is formed of a nickel alloy containing nickel in an amount of 80 wt % or more (specifically, INCONEL® 601). A proximal end portion 141*k* of the ground electrode base material 141 is welded to the distal end surface 110*sc* of the metallic shell 110, and a distal end portion 141*s* of the ground electrode base material 141 is bent toward the axis AX such that an inner side surface 141*m* facing radially inward is disposed opposite the center electrode chip 133 of the center electrode 130.

The intermediate member 142 (see FIGS. 4A and 4B) is composed of a flange portion (brim portion) 142*d* which assumes the form of a large diameter cylindrical column and is located on the distal end side (lower side in these drawings); and a cylindrical columnar portion 142*e* which assumes the form of a cylindrical column having a diameter smaller than that of the flange portion and is located on the proximal end side (upper side in these drawings). The entire intermediate member 142 is formed of a nickel alloy containing nickel in an amount of 80 wt % or more (specifically, INCONEL® 601).

Since the intermediate member 142 (flange portion 142*d*) and the ground electrode base material 141 are joined by welding, as shown in FIG. 3, a resistance-welded portion 145 is formed between the intermediate member 142 and the ground electrode base material 141 such that the resistance-welded portion 145 is convex toward the ground electrode base material 141. In particular, in the present Embodiment 1, since the intermediate member 142 and the ground electrode base material 141 are joined by means of projection welding to be described below, the intermediate member 142 and the ground electrode base material 141 are reliably welded together over a large area around the radial center of the intermediate member 142.

The ground electrode chip 143 (see FIG. 5) assumes the form of a cylindrical column, is formed of a noble metal alloy; for example, a Pt—Rh alloy, and has a diameter smaller than that of the cylindrical columnar portion 142*e*. The ground electrode chip 143 is joined to the cylindrical columnar portion 142*e* of the intermediate member 142 such that the ground electrode chip 143 projects toward the proximal end side (upper side in FIG. 3) and faces the center electrode chip 133. Since the ground electrode chip 143 and the intermediate member 142 are joined by means of laser welding, a fused metal portion 146 is formed between the ground electrode chip 143 and the intermediate member 142 as a result fusing and mixing of the ground electrode chip 143 and the intermediate member 142 with each other, and solidifying. The height h1 of the cylindrical columnar portion 142*e* (the distance between the lower end of the fused metal portion 146 and the upper surface of the flange portion 142*d* as measured along the outer circumferential surface) is 0.05 mm to 0.3 mm. The distance h2 between the lower end of the metal fused portion 146 and the upper surface of the flange portion 142*d* as measured along a center line O of the ground electrode chip 143 is equal to or greater than the height h1 of the cylindrical columnar portion. Thus, the distance between the metal fused portion 146 and the resistance-welded portion 145 increases toward the center line O.

The ground electrode chip 143 has a projection length H of 0.80 mm as measured from the inner side surface 141*m* of the ground electrode base material 141. Further, the projection height h3 of the ground electrode chip 143 from the fused metal portion 146 is made greater than the height h1 of the cylindrical columnar portion. That is, the fused metal portion 146 is formed at a position closer to the upper surface of the flange portion 142*d* than to the distal end surface of the ground electrode chip 143. This means that the projection height h3 of the ground electrode chip 143 accounts for a greater portion of the predetermined projection height H than does the height h1 of the cylindrical columnar portion, whereby the resistance of the ground electrode 140 to spark-induced ablation can be improved.

Moreover, the height h4 of the fused metal portion 146 as measured on the outer circumferential surface is made greater than the height h1 of the cylindrical columnar portion in order to secure a sufficient degree of welding strength.

The clearance between the ground electrode chip 143 and the center electrode chip 133 serves as a discharge gap G for producing spark discharge.

Next, a method for producing the above-described spark plug 100 will be described.

First, a center electrode 130 having a center electrode base material 131 and a center electrode chip 133 is fabricated in a known manner. For example, the center electrode chip 133 is laser welded to the center electrode base material 131 to thereby complete the center electrode 130.

Subsequently, in accordance with a known method, the center electrode 130 is assembled to an insulator 120, which is separately formed, and a terminal metal piece 150, etc., are also assembled to the insulator 120, followed by glass sealing. Further, a metallic shell 110 is prepared, and a bar-shaped ground electrode base material 141 (a ground electrode base material 141 to which an intermediate member 142 and a ground electrode chip 143 have not yet been joined and which has not yet been bent) is joined to the metallic shell 110 in accordance with a known method. After that, in accordance with a known method, the insulator 120, to which the center electrode 130, etc., have been assembled, is assembled to the metallic shell 110 to which the ground electrode base material 141 has been joined, and crimping and other necessary operations are performed.

Figure 4A:
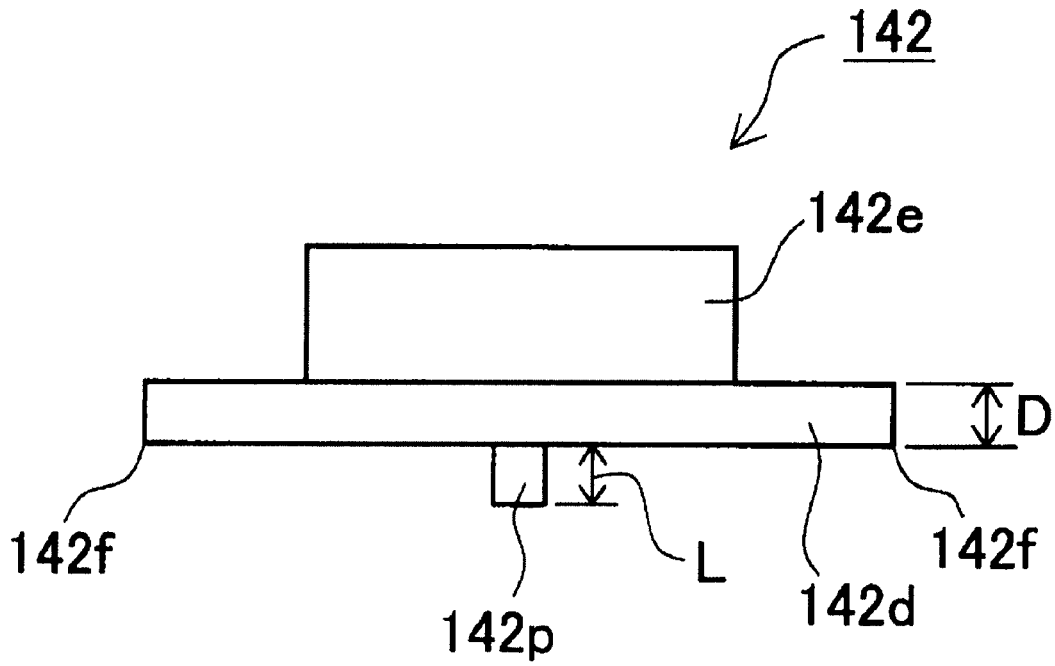
Figure 4B:
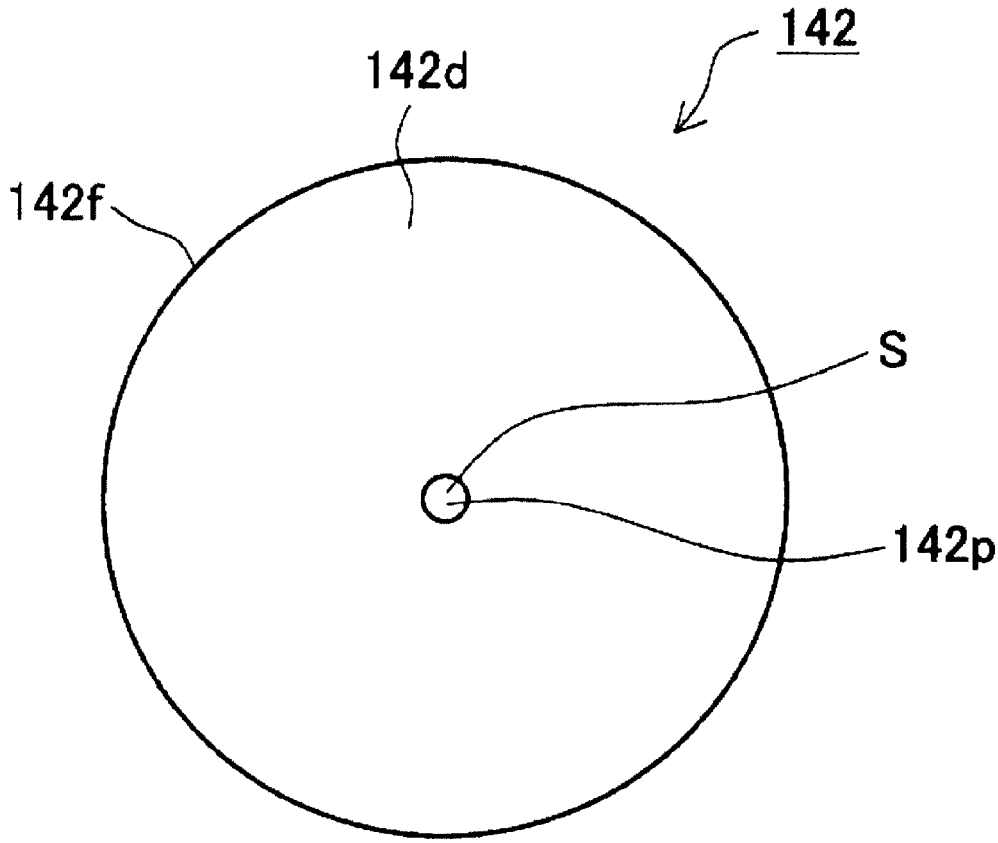

Separately, an intermediate member 142 having a projecting portion 142*p* shown in FIGS. 4A and 4B is fabricated by means of header working. This process corresponds to the projecting portion forming step of the present invention. This intermediate member 142 before welding includes a flange portion (brim portion) 142*d* which has a large diameter and a thickness D of 0.25 mm; a cylindrical columnar portion 142*e* which has a small diameter and is provided at the radial center of one main face of the flange portion 142*d*; and a single projecting portion 142*p* which is provided at the radial center of the other main face of the flange portion 142*d* and is used for projection welding to be described below. Accordingly, the projecting portion 142*p* is located on the radially inner side of the circumferential edge 142*f* of the intermediate member 142, and is disposed at the radial center of the intermediate member 142. This projecting portion 142*p* assumes the form of a cylindrical column which has a cross sectional area (average cross sectional area) S of 0.07 $mm^2$ and a projection length L of 0.10 mm.

Notably, in the projecting portion forming step, the intermediate member 142 having the projecting portion 142*p* may be fabricated by means of press working rather than header working.

Figure 5:
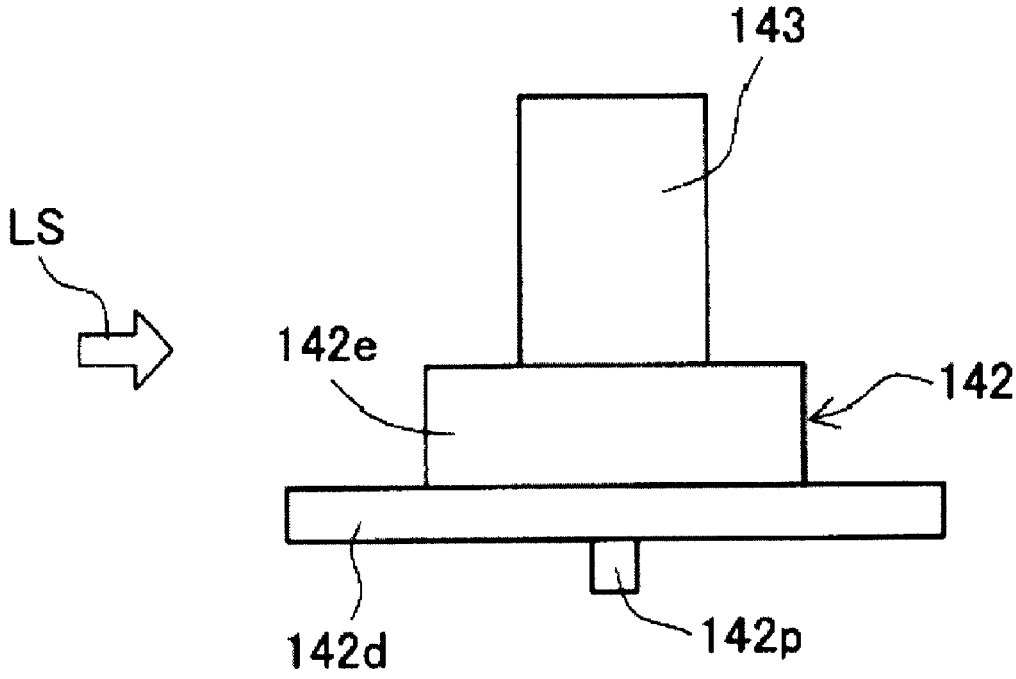
FIG. 5 relates to the method of producing the spark plug according to Embodiment 1, and is an explanatory view showing a step of laser welding a ground electrode chip to an intermediate member.
Figure 6:
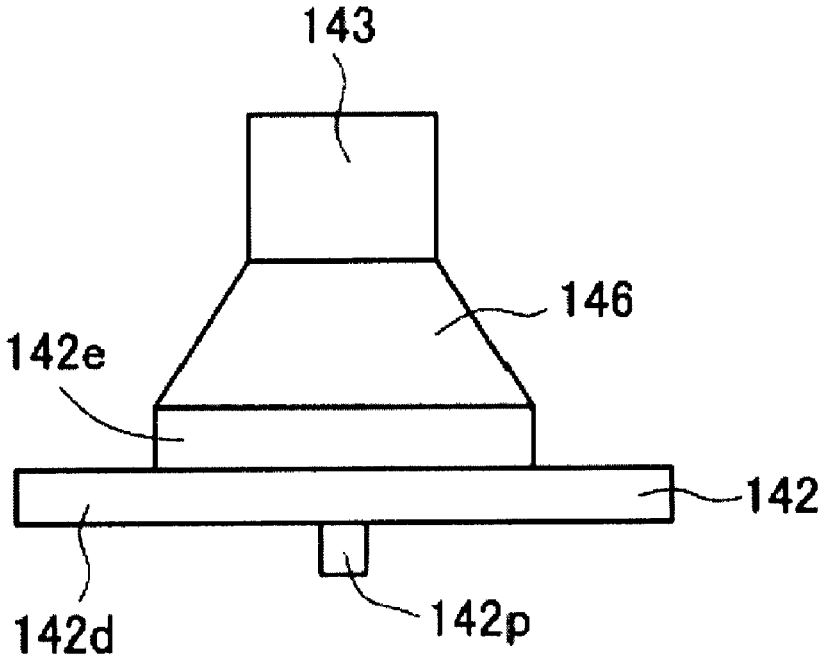
FIG. 6 relates to the method of producing the spark plug according to Embodiment 1, and is an explanatory view showing a state after the ground electrode chip is welded to the intermediate member.

Separately, a ground electrode chip 143 having a cylindrical columnar shape is prepared. Subsequently, as shown in FIG. 5, this ground electrode chip 143 is placed on a central portion of the cylindrical columnar portion 142*e* of the intermediate member 142, and a laser beam LS is applied as indicated by an arrow in FIG. 5, over a portion or the entire circumference thereof, so as to laser-weld the ground electrode chip 143 and the intermediate member 142. Thus, as shown in FIG. 6, a fused metal portion 146 is formed between the ground electrode chip 143 and the intermediate member 142 as a result of the two members fusing, mixing with each other, and solidifying. Notably, since the laser beam LS is applied generally horizontally rather than obliquely, the distance h2 between the fused metal portion 146 and the upper surface of the flange 142*d* as measured along the center line O in FIG. 3 can be made greater than the corresponding distance h1 as measured along the outer circumferential direction. Since the fused metal portion 146 is formed at a position separated from the upper surface of the flange portion 142*d*, the laser beam LS can be applied along a horizontal direction without being hindered by the flange portion 142*d*. The lower end of the fused metal portion 146 and the upper surface of the flange portion 142*d* are separated from each other by a distance corresponding to the height of the remaining cylindrical columnar portion 142*e*. The height h1 of the cylindrical columnar portion 142*e* as measured after forming the fused metal portion 146 preferably falls within a range of 0.05 mm to 0.3 mm. This height h1 of the cylindrical columnar portion 142*e* provides an effect of protecting the fused metal portion 146 from heat generated at the time of projection welding to be described below.

Figure 7:
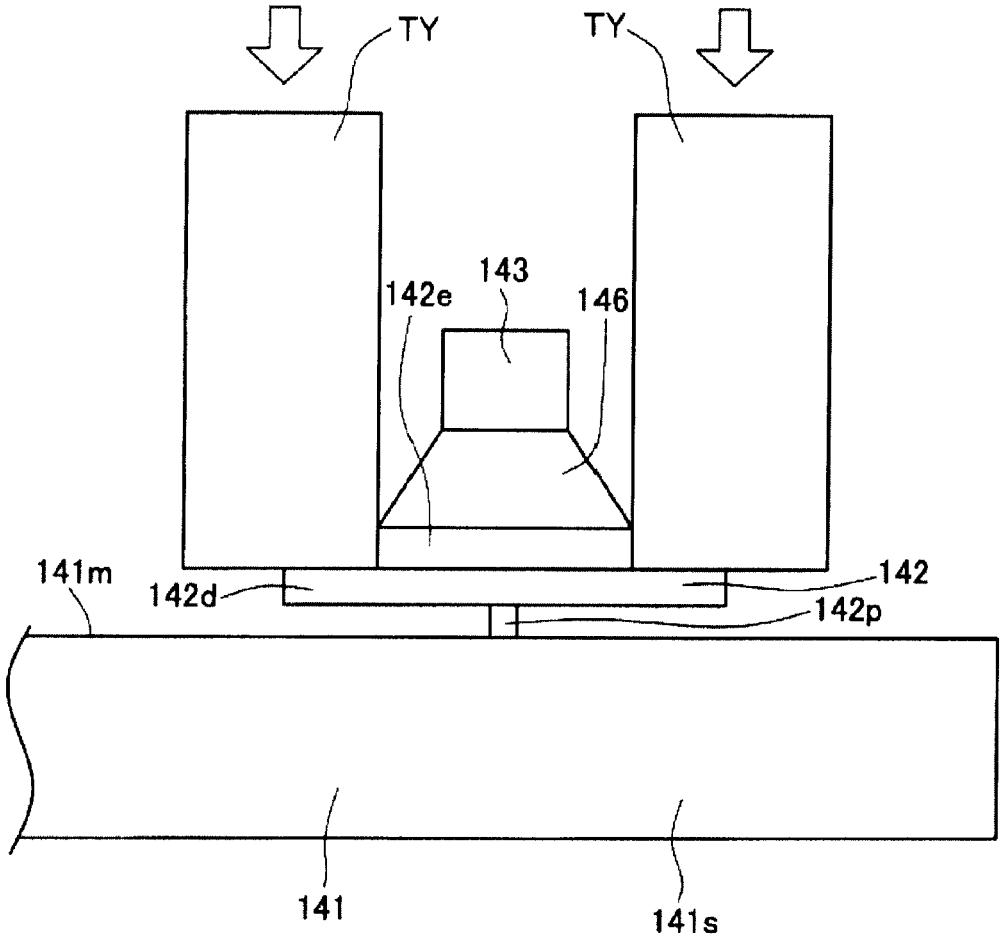
FIG. 7 relates to the method of producing the spark plug according to Embodiment 1, and is an explanatory view showing a step of projection welding the intermediate member to a ground electrode base material.

Next, in a projection welding step, as shown in FIG. 7, the intermediate member 142 with the ground electrode chip 143 joined thereto is projection-welded to the ground electrode base material 141. Specifically, a resistance welding machine TY is caused to press a peripheral portion of the flange portion 142*d* of the intermediate member 142 such that the projecting portion 142*p* of the intermediate member 142 is in pressure contact with the ground electrode base material 141. In this state, current is applied to the flange portion 142*d* and is concentrated to the projecting portion 142*p* so as to projection-weld the intermediate member 142 and the ground electrode base material 141. Thus, as shown in FIG. 3, a resistance-welded portion 145 is formed over a large area around the radially central portion such that the resistance-welded portion 145 is convex toward the ground electrode base material 141. Notably, the distance h2 between the lower end of the previously formed fused metal portion 146 and the upper surface of the flange portion 142*d* as measured along the center line O of the ground electrode chip 143 is made greater than the distance between the previously formed fused metal portion 146 and the upper surface of the flange portion 142*d* as measured along the outer circumferential surface (that is, the height h1 of the cylindrical columnar portion). Therefore, the distance between the fused metal portion 146 and the resistance-welded portion 145 can be made sufficiently large in the vicinity of the center line O at which the temperature is likely to become the highest at the time of projection welding.

After that, the ground electrode 140 is bent toward the axis AX to have a predetermined shape and form a discharge gap G between the ground electrode 140 and the center electrode 130. Thus, the above-described spark plug 100 is completed.

As described above, in the present Embodiment 1, the projecting portion 142*p* is provided on the intermediate member 142, and the intermediate member 142 and the ground electrode base material 141 are projection-welded together by means of the projecting portion 142*p*. This enables the intermediate member 142 and the ground electrode base material 141 to be reliably welded over a large area around the radial center, as compared with conventional resistance welding. Accordingly, when the spark plug 100 thus produced is subjected to a severe thermal cycle test described below, it is possible to prevent formation of a large gap between the intermediate member 142 and the ground electrode base material 141.

In particular, the projecting portion 142*p* is disposed on the radially inner side of the circumferential edge 142*f* of the intermediate member 142; for example, at the radial center. By virtue of this arrangement, the intermediate member 142 and the ground electrode base material 141 can be reliably welded over a large area around a radially central portion which contributes to heat transfer, so that heat transfer from the ground electrode chip 143 to the ground electrode base material 141 is improved. Accordingly, when the spark plug 100 thus produced is subjected to a severe thermal cycle test described below, it is possible to prevent the formation of a hollow recess in the fused metal portion 146 between the ground electrode chip 143 and the intermediate member 142, which recess would otherwise have been formed due to high-temperature oxidation.

Further, in the present Embodiment 1, the cross sectional area (average cross sectional area) S of the projecting portion 142*p* is set within a range of 0.03 $mm^2$ to 0.2 $mm^2$ inclusive (for example, set to 0.07 $mm^2$), and the projection length L is set within a range of 0.05 mm to 0.2 mm inclusive (for example, set to 0.10 mm). Accordingly, at the time of projection welding, the intermediate member 142 and the ground electrode base material 141 can be reliably welded over a large area.

Further, the thickness D of the flange portion 142*d*, which is pressed by the resistance welding machine TY, is set to be equal to 0.2 mm or greater (for example, set to 0.25 mm). Accordingly, even when the flange portion is pressed at the time of projection welding, warpage or like deformation does not occur at the flange portion 142*d*, so that the intermediate member 142 and the outer electrode base material 141 can be welded more reliably.

Moreover, in the present Embodiment 1, the entire intermediate member 142 is formed of a nickel alloy containing nickel in an amount of 80 wt % or more. Therefore, the intermediate member 142 has high thermal conductivity, whereby heat transfer from the ground electrode chip 143 to the ground electrode base material 141 is improved. Accordingly, when the spark plug 100 thus produced is subjected to a severe thermal cycle test described below, it is possible to more reliably prevent formation of a hollow recess in the fused metal portion 146 between the ground electrode chip 143 and the intermediate member 142.

Further, in the present Embodiment 1, the projecting portion 142*p* is provided on the intermediate member 142 by header working. This enables easy and reliable formation of the projecting portion 142*p* on the intermediate member 142.

EXAMPLE

In order to verify the effects of the present embodiment, spark plugs 100 of 15 types were manufactured, as Examples of the present invention, in a manner similar to the above-described Embodiment 1. In these Examples, the cross sectional area (average cross sectional area) S of the projecting portion 142*p* was varied within a range of 0.03 $mm^2$ to 0.25 $mm^2$, the projection length L was varied within a range of 0.03 mm to 0.28 mm, and the thickness D of the flange portion 142*d* of the intermediate member 142 was varied within a range of 0.15 mm to 0.25 mm, as shown in Table 1.

Meanwhile, a spark plug was manufactured, as a Comparative Example, in a manner similar to the above-described Embodiment 1, except that a projecting portion 142*p* was not provided.

TABLE 1

| | Cross sectional area S ($mm^2$) | Projection length L (mm) | Thickness D (mm) | Results of thermal cycle test |
|---|---|---|---|---|
| Example 1 | 0.03 | 0.05 | 0.20 | AA |
| Example 2 | 0.03 | 0.10 | 0.20 | AA |
| Example 3 | 0.03 | 0.20 | 0.20 | AA |
| Example 4 | 0.07 | 0.05 | 0.25 | AA |
| Example 5 | 0.07 | 0.10 | 0.15 | AA |
| Example 6 | 0.07 | 0.10 | 0.20 | AA |
| Example 7 | 0.07 | 0.10 | 0.25 | AA |
| Example 8 | 0.07 | 0.20 | 0.25 | AA |
| Example 9 | 0.20 | 0.05 | 0.25 | AA |
| Example 10 | 0.20 | 0.10 | 0.25 | AA |
| Example 11 | 0.20 | 0.20 | 0.25 | AA |
| Example 12 | 0.015 | 0.10 | 0.25 | BB |
| Example 13 | 0.25 | 0.10 | 0.25 | BB |
| Example 14 | 0.07 | 0.03 | 0.25 | BB |
| Example 15 | 0.07 | 0.28 | 0.25 | BB |
| Comparative Example | — | — | 0.25 | XX |

Next, the spark plugs 100 thus prepared were subjected to a thermal cycle test as follows. Namely, a heating cycle of heating each spark plug at 1000° C. for 2 minutes and then naturally cooling the spark plug for 1 minute was repeated 1000 times. After the test, the resistance-welded portion 145 was observed.

Specifically, the ground electrode 140 was cut along a plane passing through the axis of the intermediate member 142, and the section was etched. On the section, the joint surface between the intermediate member 142 and the ground electrode base material 141 was observed so as to determine the degree of growth of oxidized scale. The ratio of the total length of oxidized scale (the total length of unjoined portions) to the length of the intermediate member 142 (specifically, the flange portion 142*d*) in a direction perpendicular to the axis was calculated as the ratio of oxidized scale. Each sample in which the ratio of oxidized scale was less than 10% was determined to be very good, and was given a grade of "AA" in the table. Each sample in which the ratio of oxidized scale was within a range of 10% to 50% inclusive was determined to be relatively good, and was given a grade of "BB" in the table. A sample in which the ratio of oxidized scale was greater than 50% was determined to be poor, and was given a grade of "XX" in the table.

In Examples 1 to 15 in which a projecting portion 142*p* was provided, the ratio of oxidized scale was at most 50%, and a good result was attained. In contrast, in the Comparative Example, in which a projecting portion 142*p* was not provided, the ratio of oxidized scale exceeded 50%. These results show that projection welding with projecting portion 142*p* provides an improved joint between the intermediate member 142 and the ground electrode base material 141, and the resulting spark plug can endure a severe thermal cycle test.

Next, the results of Examples 1 to 15 will be studied in detail. In Examples 1 to 11, in which the cross sectional area S of the projecting portion 142*p* was set to fall within the range of 0.03 $mm^2$ to 0.20 $mm^2$ and the projection length L was set to fall within the range of 0.05 mm to 0.20 mm, the ratio of oxidized scale was small; i.e., less than 10%, and a very good result was attained.

In contrast, in Examples 12 and 13, in which the cross sectional area S of the projecting portion 142*p* was set to 0.015 $mm^2$ or 0.25 $mm^2$, the ratio of oxidized scale was relatively small; i.e., in a range of 10% to 50% inclusive, and a relatively good result was attained. However, the ratio of oxidized scale increased as compared with the above-described Examples 1 to 11. This shows that setting the cross sectional area S of the projecting portion 142*p* to within the range of 0.03 $mm^2$ to 0.20 $mm^2$ is preferred.

Further, in Examples 14 and 15, in which the projection length L was set to 0.03 mm or 0.28 mm, the ratio of oxidized scale was relatively small; i.e., in a range of 10% to 50% inclusive, and a relatively good result was attained. However, the ratio of oxidized scale increased as compared with the above-described Examples 1 to 11. This shows that setting the projection length L within the range of 0.05 mm to 0.20 mm is preferred.

Moreover, for the manufactured spark plugs 100 of Examples 5 to 7, visual inspection was carried out so as to determine whether or not the intermediate member 142 had become warped, as shown in Table 2. A sample which did not become warped was determined to be good and was given a grade of "AA" in the table. Meanwhile, a sample which did become warped was determined to be bad and was given a grade of "XX" in the table.

TABLE 2

| | Cross sectional area S ($mm^2$) | Projection length L (mm) | Thickness D (mm) | Warpage Determination |
|---|---|---|---|---|
| Example 5 | 0.07 | 0.10 | 0.15 | XX |
| Example 6 | 0.07 | 0.10 | 0.20 | AA |
| Example 7 | 0.07 | 0.10 | 0.25 | AA |

In Examples 6 and 7, in which the thickness D of the flange portion 142*d* of the intermediate member 142 was set to 0.20 mm or 0.25 mm, the intermediate member 142 did not become warped. Meanwhile, in Example 5, in which the thickness D was set to 0.15 mm, the flange portion 142*d* of the intermediate member 142 did become warped. These results show that in order to eliminate warpage, the thickness D of the flange portion 142*d* of the intermediate member 142 is desirably set to 0.20 mm or more.

Modified Embodiment

Figure 8:
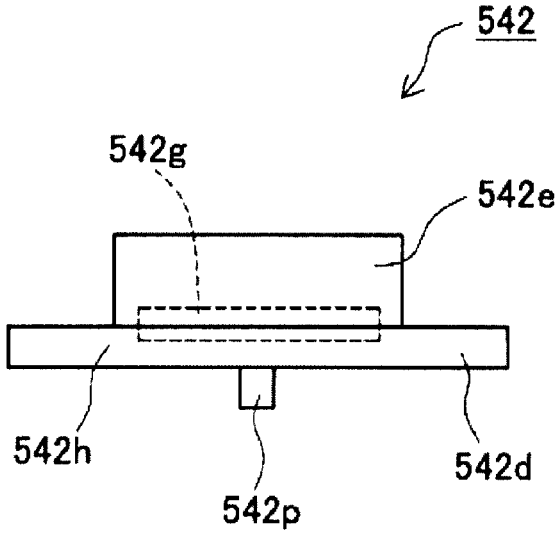
FIG. 8 relates to a spark plug production method according to a modified embodiment, and is a side view of an intermediate member used in producing the spark plug.

Next, a modification of the above-described Embodiment I will be described. Notably, the descriptions of portions similar to those of the above-described Embodiment 1 are not repeated or are simplified. FIG. 8 shows an intermediate member 542 used for producing a spark plug 500 according to the present modification. The present modification is identical to the above-described Embodiment 1, except that the intermediate member 542 used for producing the spark plug 500 differs from the intermediate member 142 (see FIGS. 4A and 4B) of the above-described Embodiment 1.

This intermediate member 542 has the same outer shape as that of the intermediate member 142 of the above-described Embodiment 1. That is, the intermediate member 542 is composed of a flange portion (brim portion) 542*d* which has a large diameter; a cylindrical columnar portion 542*e* which is provided at the radial center of one main face of the flange portion 542*d* and which has a small diameter; and a single projecting portion 542*p* provided at the radial center of the other main face of the flange portion 542*d*.

However, the interior of the intermediate member 542 differs from that of the intermediate member 142 of the above-described Embodiment 1. That is, the intermediate member 542 includes a Cu metal portion 542*g* formed of Cu, which has a high thermal conductivity, and a high-Ni-content alloy portion 542*h* enclosing the Cu metal portion 542*g*. The high- Ni-content alloy portion 542*h* is formed of a nickel alloy containing nickel in an amount of 80 wt % or more (for example, INCONEL® 601).

Since the intermediate member 542 includes the Cu metal portion 542*g* having a very high heat conductivity, the heat conductivity of the entire intermediate member 542 is also high, so that heat transfer from the ground electrode chip 143 to the ground electrode base material 141 is improved. Accordingly, when a severe thermal cycle test as described above is carried out, it is possible to more reliably prevent formation of a hollow recess in the fused metal portion between the ground electrode chip 143 and the intermediate member 542.

Embodiment 2

Figure 9A:
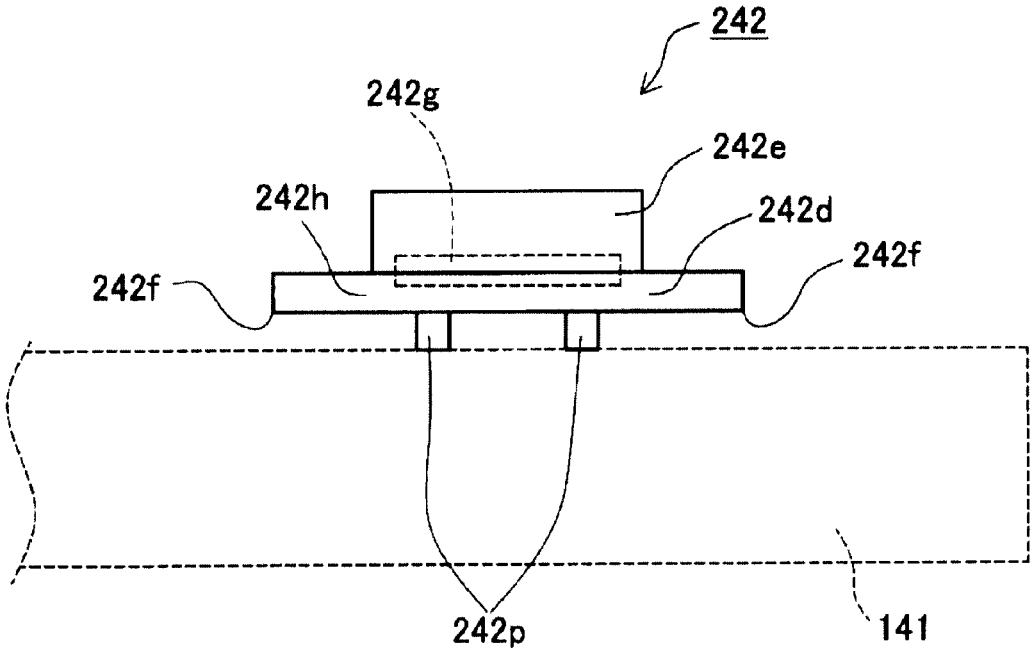
Figure 9B:
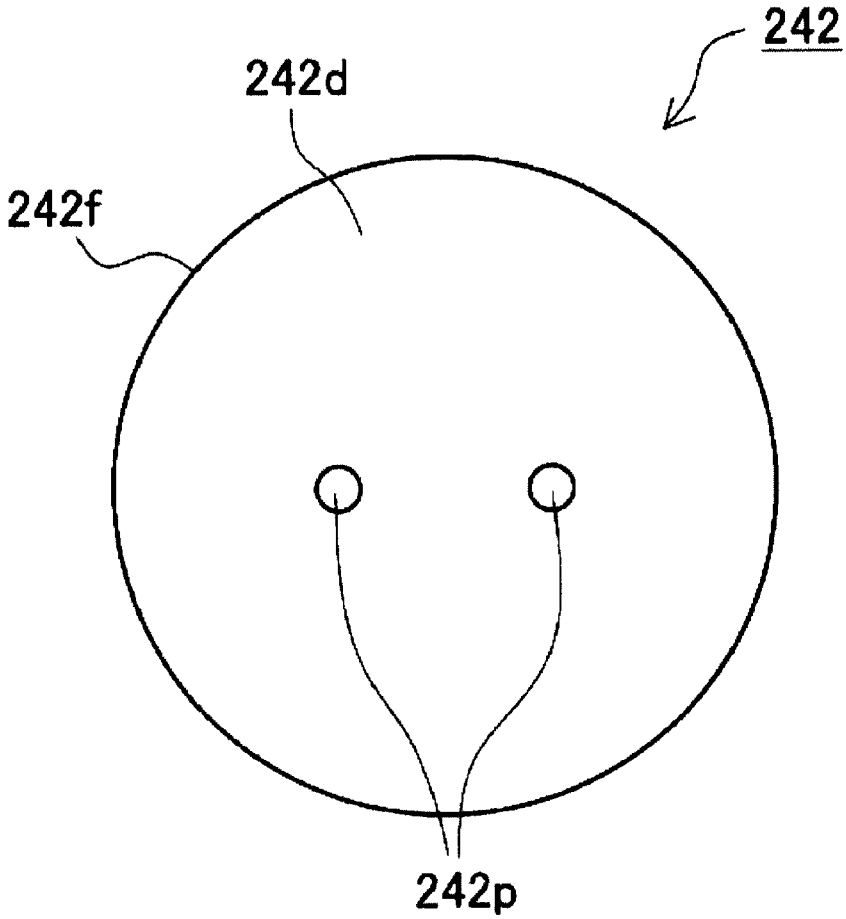

Next, a second embodiment will be described. Notably, the descriptions of portions similar to those of the above-described Embodiment 1 are not repeated or are simplified. FIGS. 9A and 9B show an intermediate member 242 used for producing a spark plug 200 according to the present Embodiment 2. The present Embodiment 2 is basically identical to the above-described Embodiment 1, except that the intermediate member 242 used for producing the spark plug 200 differs from the intermediate member 142 (see FIGS. 4A and 4B) of the above-described Embodiment 1.

This intermediate member 242 includes a Cu metal portion 242*g* formed of copper, and a high-Ni-content alloy portion 242*h* formed of a nickel alloy and covering the Cu metal portion 242*g*. The intermediate member 242 has a flange portion 242*d* having a large diameter and a cylindrical columnar portion 242*e* having a small diameter. A plurality of (two) projecting portions 242*p* for performing projection welding are provided on the flange portion 242*d* on the radially inner side of the circumferential edge 242*f* of the intermediate member 242. Even in a case where a plurality of projecting portions 242*p* are provided as described above, and the intermediate member 242 is projection-welded to the ground electrode base material 141 by use of these projecting portions 242*p*, the intermediate member 242 and the ground electrode base material 141 can be reliably welded together over a large area covering the vicinity of the radial center of the intermediate member 242. The portions similar to those of the above-described Embodiment 1 achieve the same action and effects as those of the above-described Embodiment 1.

Embodiment 3

Figure 10A:
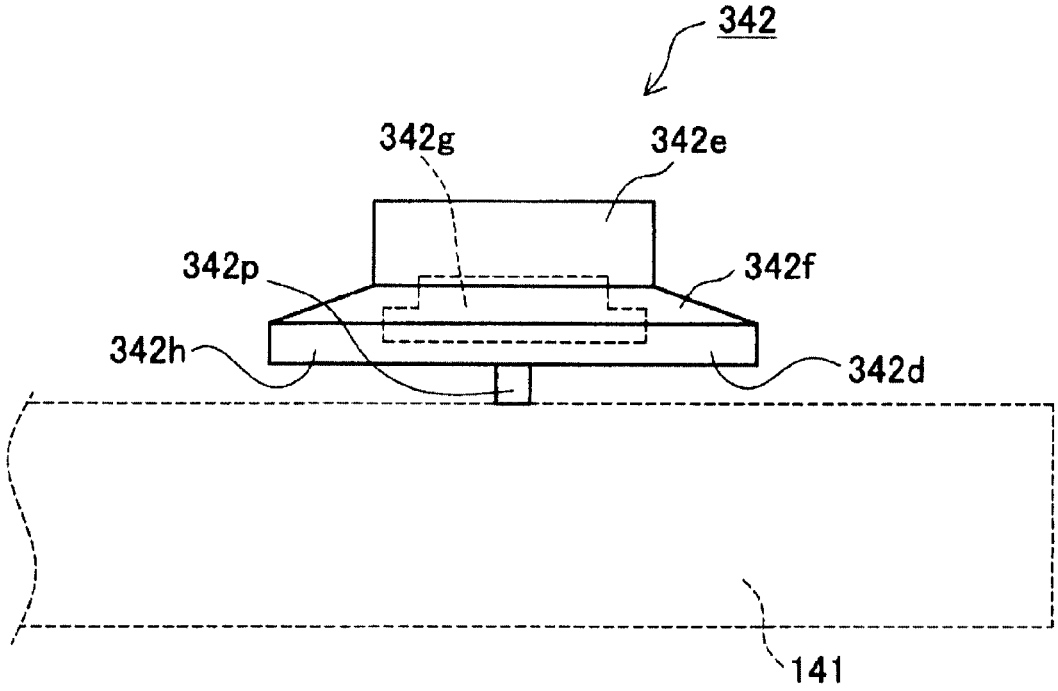
Figure 10B:
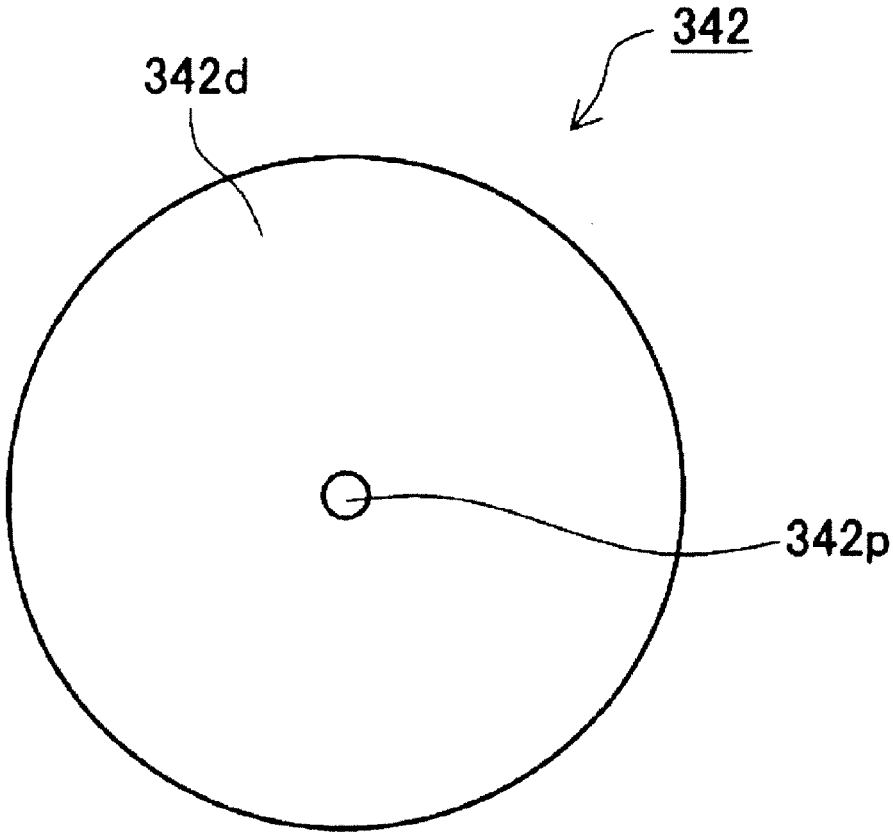

Next, a third embodiment will be described. Notably, the descriptions of portions similar to those of the above-described Embodiment 1 or 2 are not repeated or are simplified. FIGS. 10A and 10B show an intermediate member 342 used for producing a spark plug 300 according to the present Embodiment 3. The present Embodiment 3 is basically identical to the above-described Embodiments 1 and 2, except that the intermediate member 342 used for producing the spark plug 300 differs from the intermediate members 142 and 242 of the above-described Embodiments 1 and 2.

This intermediate member 342 includes a Cu metal portion 342*g* formed of copper, and a high-Ni-content alloy portion 342*h* formed of a nickel alloy and covering the Cu metal portion 342*g*. The intermediate member 342 has a flange portion 342*d* having a large diameter; a cylindrical columnar portion 342*e* having a small diameter; and a taper portion 342*f* located therebetween. A single projecting portion 342*p* for performing projection welding is provided at the radial center of the flange portion 342*d*. Even in the case of using an intermediate member 342 having a taper portion 342*f*, when the intermediate member 342 and the ground electrode base material 141 are projection welded using the projecting portion 342*p*, the intermediate member 342 and the ground electrode base material 141 can be reliably welded together over a large area around the radial center of the intermediate member 342. Portions similar to those of the above-described Embodiment 1 or 2 achieve the same action and effects as those of the above-described Embodiment 1 or 2.

Embodiment 4

Figure 11:
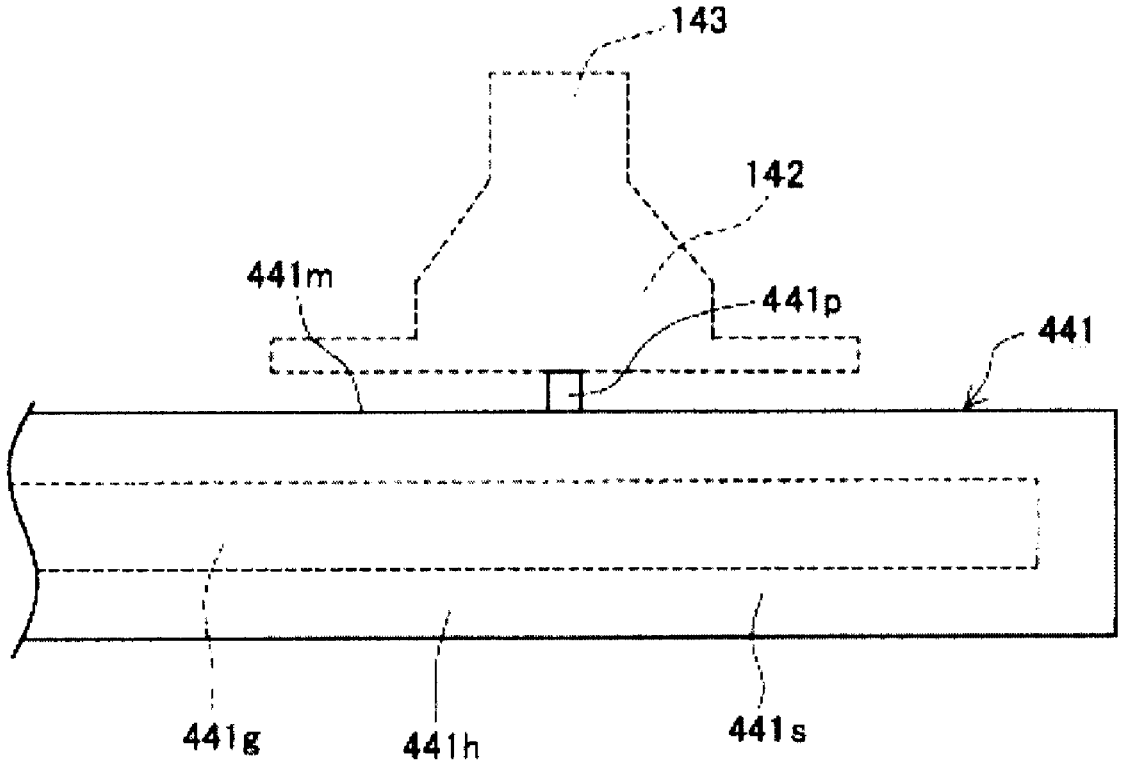
FIG. 11 relates to a spark plug according to Embodiment 4, and is a side view of a distal end portion of a ground electrode base material.

Next, a fourth embodiment will be described. Notably, the descriptions of portions similar to those of any one of the above-described Embodiments 1 to 3 are not repeated or are simplified. FIG. 11 shows a ground electrode base material 441 used for producing a spark plug 400 according to the present Embodiment 4. The present Embodiment 4 is basically identical to the above-described Embodiments 1 or the like, except that the ground electrode base material 441 differs from the ground electrode base material 141 of the above-described Embodiments 1 to 3.

This ground electrode base material 441 includes a Cu metal portion 441*g* formed of copper, and a high-Ni-content alloy portion 441*h* formed of a nickel alloy and covering the Cu metal portion 441*g*. A single projecting portion 441*p* for performing projection welding is provided at a predetermined position on an inner side surface 441*m* of a distal end portion 441*s* of the ground electrode base material 441. When projection welding is performed, the projecting portion 441*p* is disposed on the radially inner side of the circumferential edge of the intermediate member 142; for example, at the radial center thereof. In this manner, the intermediate member 142, to which the ground electrode chip 143 has been joined, is placed on the ground electrode base material 441.

As described above, even when the projecting portion 441*p* is provided on the ground electrode base material 441, and the intermediate member 142 is projection-welded to the ground electrode base material 441 by use of the projecting portion 441*p*, the intermediate member 142 and the ground electrode base material 441 can be reliably welded together over a large area around the radial center of the intermediate member 142. Notably, the ground electrode base material 441 including the projecting portion 441*p* according to the present Embodiment 4 can be formed by means of press working. Portions similar to those of any one of the above-described Embodiments 1 to 3 achieve the same action and effects as those of the above-described Embodiments 1 to 3.

The present invention has been described above in reference to Embodiments 1 to 4. However, the present invention is not limited thereto, and may be modified without departing from the gist of the invention.

In the above-described Embodiments 1 to 3, the projecting portion (142*p*, 242*p*, 342*p*) is provided only on the intermediate member (142, 242, 342) alone, and in the above-described Embodiment 4, the projecting portion (441*p*) is only provided on the ground electrode base material (441) alone. However, a projecting portion may be provided on both of the intermediate member and the ground electrode base material. In this case as well, the intermediate member and the ground electrode base material can be reliably welded over a large area through projection welding using one or more of these projecting portions.

It should further be apparent to those skilled in the art that various changes in form and detail of the invention as shown and described above may be made. It is intended that such changes be included within the spirit and scope of the claims appended hereto.

This application is based on Japanese Patent Application No. JP 2007-85309 filed Mar. 28, 2007, incorporated herein by reference in its entirety.

What is claimed is:

1. A method for producing a spark plug which includes a center electrode and an outer electrode facing the center electrode via a discharge gap and configured such that an outer electrode chip is joined to an outer electrode base material via an intermediate member, the method comprising:

(A) forming a projecting portion on at least one of said intermediate member and said outer electrode base material by means of header working or press working, (B) joining the outer electrode chip and the intermediate member by means of laser welding, and (C) projection-welding said intermediate member to said outer electrode base material by means of said projecting portion provided on at least one of said intermediate member and said outer electrode base material wherein steps (A) and (B) precede step (C).

2. The method for producing a spark plug according to claim 1, wherein said projecting portion is provided on at least one of said intermediate member and said outer electrode base material such that, at the time of said projection welding, said projecting portion is located radially inward of a circumferential edge of said intermediate member.

3. The method for producing a spark plug according to claim 2, wherein said projecting portion is provided on at least one of said intermediate member and said outer electrode base material such that, at the time of said projection welding, said projecting portion is located at a radially central portion of said intermediate member.

4. The method for producing a spark plug according to claim 1, wherein said projecting portion has an average cross sectional area of 0.03 $mm^2$ to 0.2 $mm^2$ inclusive, as measured perpendicular to an axial direction of said projecting portion, and a projection length of 0.05 mm to 0.2 mm inclusive.

5. The method for producing a spark plug according to claim 1, which comprises pressing a brim portion of said intermediate member by a resistance welding machine at the time of said projection welding, said brim portion having a thickness of 0.2 mm or greater.

6. The method for producing a spark plug according to claim 1, wherein said intermediate member is formed of a nickel alloy containing nickel in an amount of 80 wt % or more.

7. A method for producing a spark plug according to claim 1, wherein said intermediate member comprises a nickel alloy portion formed of a nickel alloy, and a copper metal portion embedded in the nickel alloy portion.

* * * * *